US009383098B2

(12) United States Patent
Means et al.

(10) Patent No.: US 9,383,098 B2
(45) Date of Patent: Jul. 5, 2016

(54) RADIAL FLOW FUEL NOZZLE FOR A COMBUSTOR OF A GAS TURBINE

(71) Applicant: General Electric Company, Schenectady, NY (US)

(72) Inventors: Gregory Scott Means, Simpsonville, SC (US); Gregory Allen Boardman, Greer, SC (US); Jonathan Dwight Berry, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 804 days.

(21) Appl. No.: 13/664,705

(22) Filed: Oct. 31, 2012

(65) Prior Publication Data

US 2014/0116054 A1 May 1, 2014

(51) Int. Cl.

| | |
|---|---|
| ***F23D 11/24*** | (2006.01) |
| ***F23R 3/28*** | (2006.01) |
| ***F23D 14/00*** | (2006.01) |
| ***F23R 3/34*** | (2006.01) |
| ***F23R 3/46*** | (2006.01) |
| ***F23D 11/38*** | (2006.01) |

(52) U.S. Cl.

CPC ..... *F23D 11/24* (2013.01); *F23D 11/38* (2013.01); *F23D 14/00* (2013.01); *F23R 3/283* (2013.01); *F23R 3/286* (2013.01); *F23R 3/343* (2013.01); *F23R 3/46* (2013.01); *F23D 2900/00015* (2013.01); *F23R 2900/00012* (2013.01); *F23R 2900/03044* (2013.01)

(58) Field of Classification Search

CPC ..... F23R 3/283; F23R 3/286; F23R 3/343; F23D 14/62; F23D 11/24; F23D 14/00

USPC ..... 60/739; 431/193, 158

See application file for complete search history.

(56) References Cited

U.S. PATENT DOCUMENTS

| | | | | |
|---|---|---|---|---|
| 5,437,159 | A | 8/1995 | Ansart et al. | |
| 5,924,275 | A | 7/1999 | Cohen et al. | |
| 5,983,642 | A * | 11/1999 | Parker | F02C 7/222 239/403 |
| 6,397,602 | B2 | 6/2002 | Vandervort et al. | |
| 6,446,439 | B1 * | 9/2002 | Kraft | F23R 3/286 607/739 |
| 2006/0107667 | A1 * | 5/2006 | Haynes | F23R 3/286 60/776 |
| 2008/0268387 | A1 * | 10/2008 | Saito | F23R 3/286 431/8 |
| 2009/0014561 | A1 * | 1/2009 | McMasters | B22F 3/225 239/533.12 |
| 2009/0145983 | A1 | 6/2009 | Stuttaford et al. | |
| 2009/0255264 | A1 * | 10/2009 | McMasters | F02K 9/52 60/747 |
| 2011/0131998 | A1 * | 6/2011 | Nadkarni | F23R 3/54 60/737 |
| 2011/0289933 | A1 * | 12/2011 | Boardman | F23R 3/36 60/776 |

* cited by examiner

*Primary Examiner* — Gerald L Sung
*Assistant Examiner* — Scott Walthour
(74) *Attorney, Agent, or Firm* — Dority & Manning, PA

(57) ABSTRACT

A combustor for a gas turbine generally includes a radial flow fuel nozzle having a fuel distribution manifold, and a fuel injection manifold axially separated from the fuel distribution manifold. The fuel injection manifold generally includes an inner side portion, an outer side portion, and a plurality of circumferentially spaced fuel ports that extend through the outer side portion. A plurality of tubes provides axial separation between the fuel distribution manifold and the fuel injection manifold. Each tube defines a fluid communication path between the fuel distribution manifold and the fuel injection manifold.

20 Claims, 10 Drawing Sheets

RADIAL FLOW FUEL NOZZLE FOR A COMBUSTOR OF A GAS TURBINE

FEDERAL RESEARCH STATEMENT

This invention was made with Government support under grant number DE-FC26-05NT42643-ARRA, awarded by the Department of Energy. The Government has certain rights in this invention.

FIELD OF THE INVENTION

The present invention generally involves a dual-fuel combustor of a gas turbine. More particularly, the invention relates to a radial flow fuel nozzle for providing liquid fuel to the dual fuel combustor.

BACKGROUND OF THE INVENTION

Gas turbines are widely used in industrial and power generation operations. A typical gas turbine may include a compressor section, a combustor downstream from the compressor section, and a turbine section downstream from the combustor. A working fluid such as ambient air flows into the compressor section where it is compressed before flowing into the combustor. The compressed working fluid is mixed with a fuel and burned within the combustor to generate combustion gases having a high temperature, pressure, and velocity. The combustion gases flow from the combustor and expand through the turbine section to rotate a shaft and to produce work.

The combustor generally operates on a liquid or a gaseous fuel. However, the flexibility to operate a combustor on either a liquid or a gas fuel has proven to be beneficial to gas turbine operators. For example, dual fuel capability may allow the gas turbine operator to select a particular type of fuel for combustion based on various factors such as fuel costs, fuel availability, emissions requirements and/or overall plant efficiency requirements. Therefore, an improved dual fuel combustor, in particular an improved fuel nozzle for providing a liquid fuel to a dual fuel combustor, would be useful.

BRIEF DESCRIPTION OF THE INVENTION

Aspects and advantages of the invention are set forth below in the following description, or may be obvious from the description, or may be learned through practice of the invention.

One embodiment of the present invention is a radial flow fuel nozzle for a combustor of a gas turbine. The radial flow fuel nozzle generally includes a fuel distribution manifold and a fuel injection manifold axially separated from the fuel distribution manifold. The fuel injection manifold generally includes an inner side portion, an outer side portion, and a plurality of circumferentially spaced fuel ports that extend through the outer side portion. A plurality of tubes provides axial separation between the fuel distribution manifold and the fuel injection manifold. Each tube defines a fluid communication path between the fuel distribution manifold and the fuel injection manifold Another embodiment of the present invention is a combustor. The combustor generally includes an end cover having an outer side axially separated from an inner side. A center fuel nozzle extends axially away from the inner side of the end cover. A radial flow fuel nozzle at least partially surrounds the center fuel nozzle. The radial flow fuel nozzle generally includes a fuel distribution manifold and a fuel injection manifold downstream from the fuel distribution manifold. The fuel injection manifold defines a plurality of circumferentially spaced fuel ports. The fuel ports extend generally radially through an outer side portion of the fuel injection manifold. A plurality of tubes extends between the fuel distribution manifold and the fuel injection manifold. Each of the tubes defines a fluid communication path between the fuel distribution manifold and the fuel injection manifold.

The present invention may also include a combustor including an annular array of tube bundles that extends radially across at least a portion of the combustor. Each tube bundle includes a downstream plate and a plurality of tubes that extend through the downstream plate. A fuel nozzle passage extends generally axially through the annular array of tube bundles. A radial flow fuel nozzle extends axially through the fuel nozzle passage. The radial flow fuel nozzle generally includes a fuel distribution manifold and a fuel injection manifold downstream from the fuel distribution manifold. The fuel injection manifold includes an inner side portion, an outer side portion, and a plurality of circumferentially spaced fuel ports. The fuel ports extend through the outer side portion of the fuel injection manifold. A plurality of tubes extends between the fuel distribution manifold and the fuel injection manifold. Each tube defines a fluid communication path between the fuel distribution manifold and the fuel injection manifold. An outer shroud circumferentially surrounds the fuel injection manifold. The outer shroud defines a plurality of circumferentially spaced passages that extend radially through the outer shroud. At least some of the passages may be aligned with at least some of the fuel ports of the fuel injection manifold.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
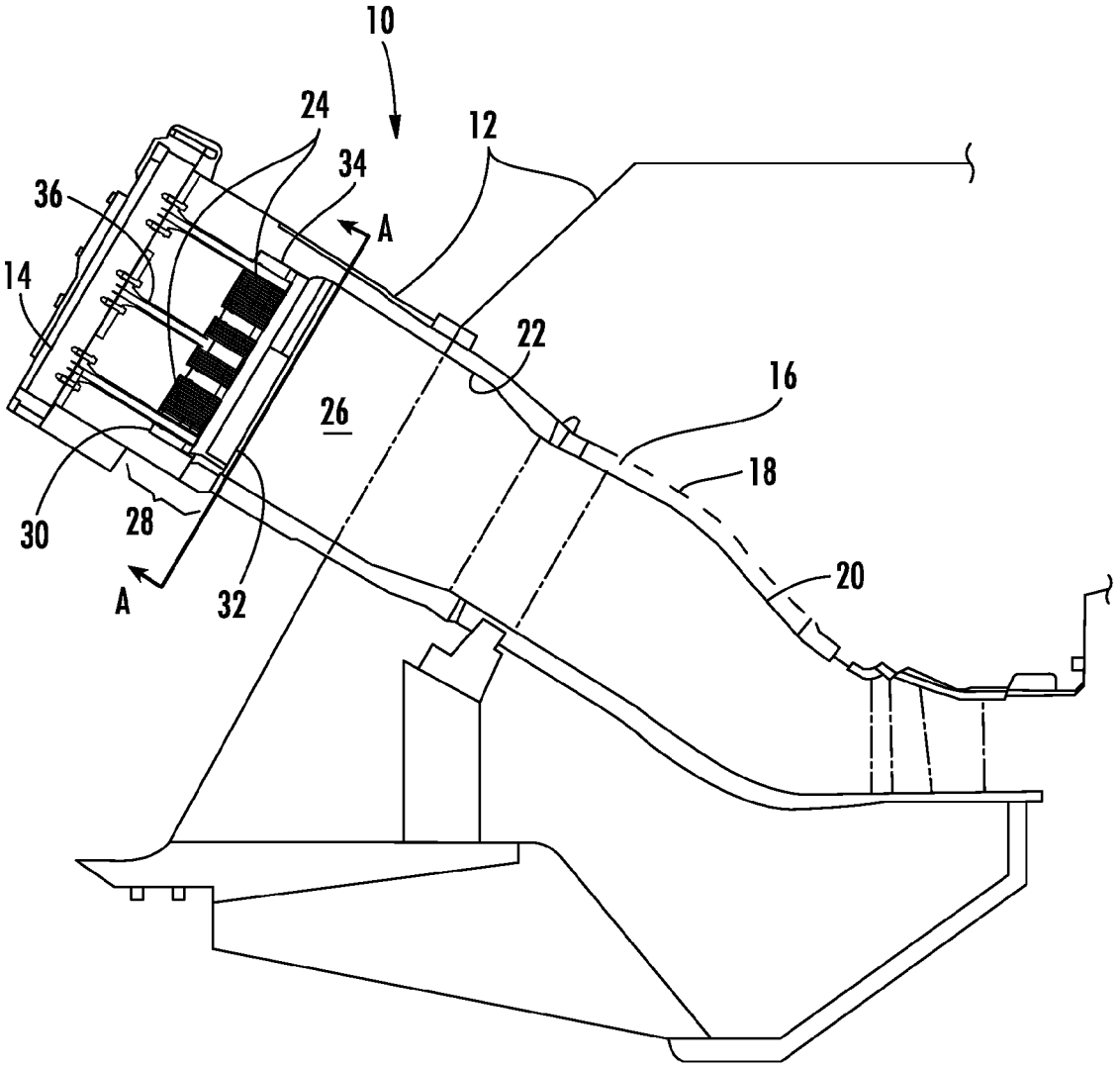
FIG. 1 is a simplified cross-section view of an exemplary combustor within the scope of various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a radial flow fuel nozzle for dispersing a liquid fuel across a downstream plate of a tube bundle disposed within a duel fuel combustor. Referring now to the drawings, FIG. 1 illustrates a simplified cross-section view of an exemplary combustor 10, such as would be included in a gas turbine, within the scope of various embodiments of the present invention. A casing 12 and an end cover 14 surrounds the combustor 10 to contain a working fluid flowing to the combustor 10. The working fluid passes through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through a plurality of tubes 24 and into a combustion chamber 26.

The tubes are radially arranged in a cap assembly 28 upstream from the combustion chamber 26. As shown, the cap assembly 28 generally extends radially across at least a portion of the combustor 10 and includes an upstream plate 30 axially separated from a downstream plate 32. A shroud 34 circumferentially surrounds the upstream and downstream plates 30, 32. A fuel plenum (not shown) may be at least partially defined within the shroud. A conduit 36 extends from the end cover 14 through the upstream plate 30 to provide fluid communication for fuel, diluents, and/or other additives to flow from the end cover 14, through the conduit 36, and into the fuel plenum.

Each tube 24 extends from the upstream plate 30 through the downstream plate 32 of the cap assembly 28 to provide fluid communication for the working fluid to flow through the cap assembly 28 and into the combustion chamber 26. Each or some of the tubes may define one or more fuel passages (not shown) that define a flow path for fluid communication between the fuel plenum and the combustion chamber. Although generally illustrated as cylindrical tubes, the tubes 24 may be any geometric shape, and the present invention is not limited to any particular cross-section unless specifically recited in the claims.

Figure 2:
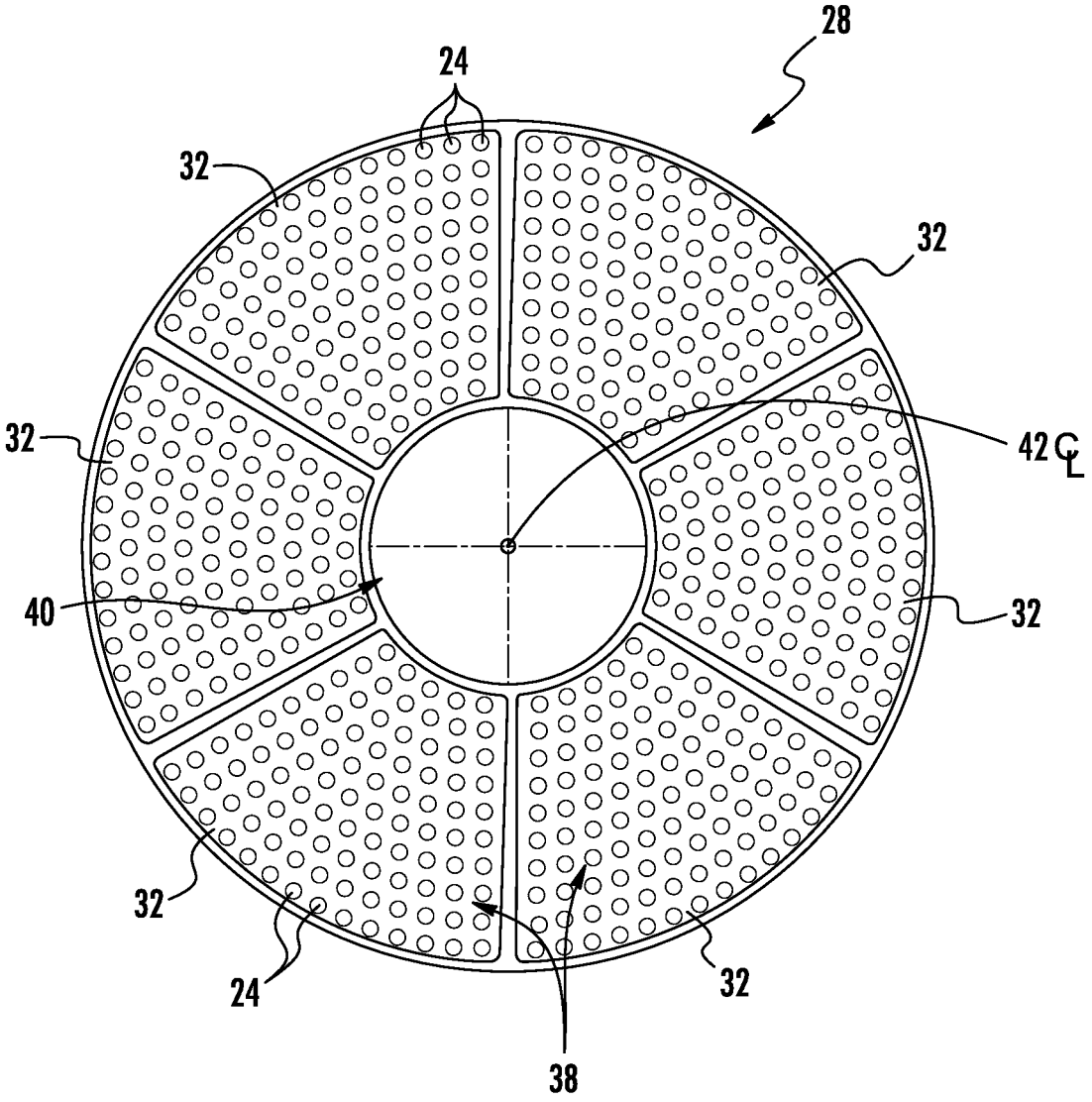
FIG. 2 is an upstream view of a tube bundle of a cap assembly within the scope of various embodiments of the present invention.

FIG. 2 illustrates an upstream view of a portion of the cap assembly 28 according to various embodiments of the present disclosure. The combustor 10 may include different numbers, shapes, and arrangements of the tubes 24 separated into one or more tube bundles 38 that extend radially across at least a portion of the cap assembly 28. The cap assembly 28 includes a single downstream plate 32 or a plurality of downstream plates 32. The tubes 24 in each tube bundle 38 may be grouped in circular, triangular, square, or other geometric shapes, and the tube bundles 38 may be arranged in various numbers and geometries in the end cap assembly 28. In particular embodiments, as shown in FIG. 2, the tubes 24 are arranged in an annular array of multiple pie-shaped tube bundles 38. The pie-shaped tube bundles 38 define a fuel nozzle passage 40 that extends through the pie-shaped tube bundles 38 along an axial centerline 42 of the cap assembly 28.

Figure 3:
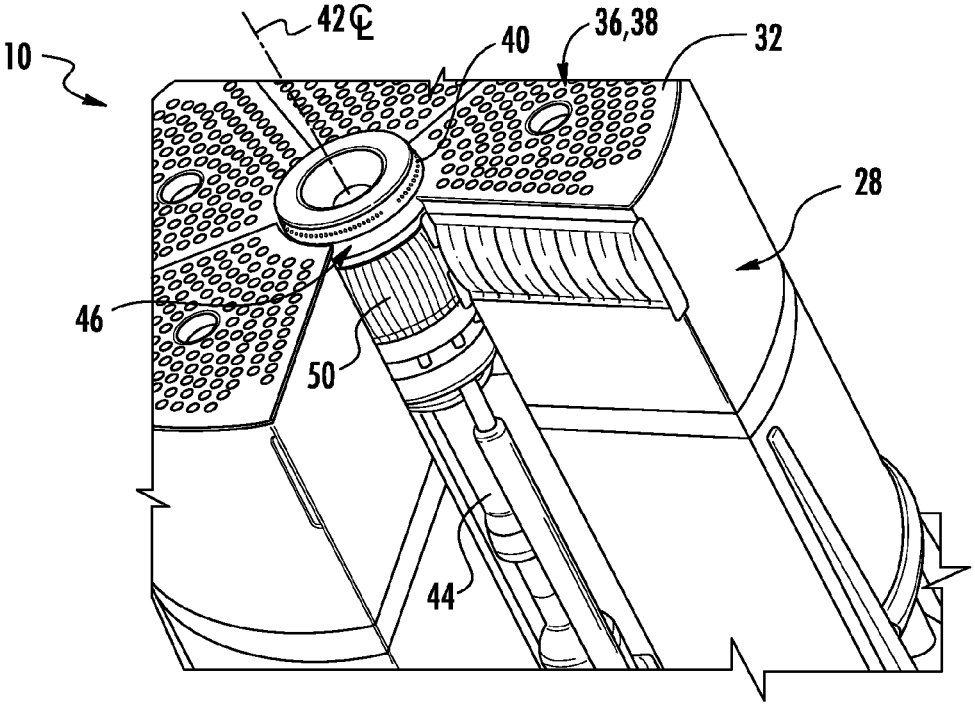
FIG. 3 is an top perspective view of a portion of a combustor within the scope of various embodiments of the present disclosure.
Figure 4:
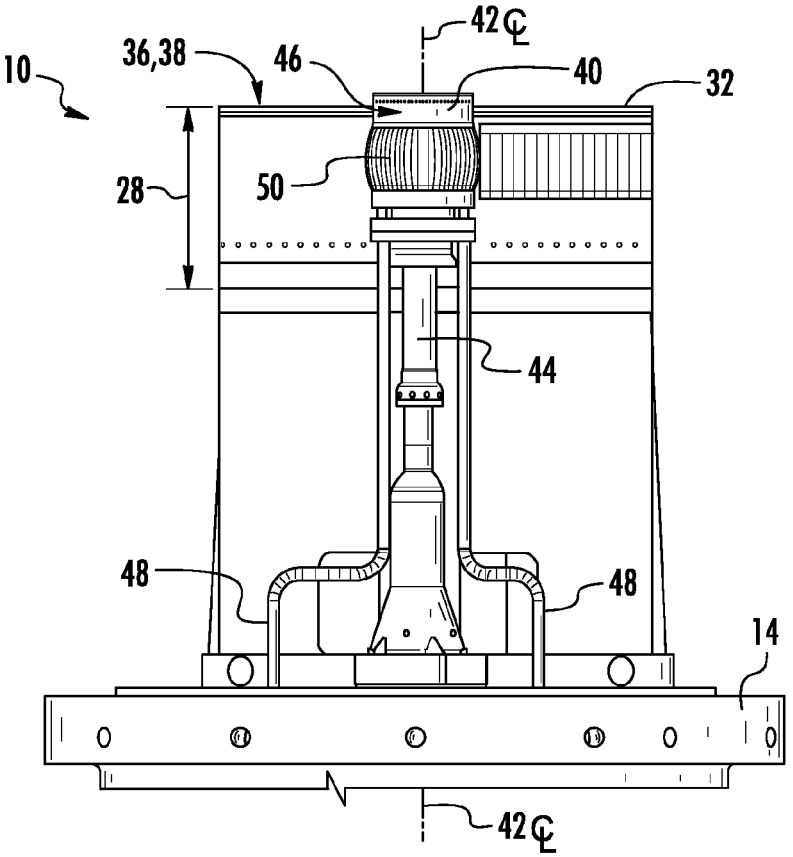
FIG. 4 is a side view of a portion of the combustor as shown in FIG. 3, within the scope of various embodiments of the present disclosure.

FIG. 3 illustrates an upstream plan view of a portion of the combustor 10 having a plurality of the pie-shaped tube bundles 38 according to various embodiments of the present disclosure, and FIG. 4 illustrates a side view of a portion of the combustor 10 as shown in FIG. 3. As shown in FIGS. 3 and 4, the combustor 10 further includes a center fuel nozzle 44 that extends at least partially through the fuel nozzle passage 40 along the axial centerline 42 of the cap assembly 28.

In particular embodiments, as shown in FIGS. 3 and 4, the combustor includes a radial flow fuel nozzle 46 that extends at least partially through the fuel nozzle passage 40 defined by the tube bundles 38 along the axial centerline 42 of the cap assembly 28. As shown, at least a portion of the radial flow fuel nozzle extends downstream from the downstream plate 32 of each of the tube bundles 38. In particular embodiments, the radial flow fuel nozzle 46 circumferentially surrounds at least a portion of the center fuel nozzle 44.

As shown in FIG. 4, the radial flow fuel nozzle 46 is connected to a flexible conduit 48. The flexible conduit 48 generally defines a fluid flow path between the end cover 14 and the radial flow fuel nozzle 46. The flexible conduit 48 is configured to allow for movement of the radial flow fuel nozzle 46 along the axial centerline 42 of the cap assembly 28, thereby allowing for linear thermal expansion of the radial flow fuel nozzle 46 during operation of the combustor 10.

In various embodiments, as shown in FIGS. 3 and 4, a radial seal 50 extends at least partially circumferentially around the radial flow fuel nozzle 46. The radial seal 50 provides mounting support and/or provide a fluid seal between the radial flow fuel nozzle 46 and the tube bundles 38 of the cap assembly 28. The radial seal 50 may include a spring seal or any seal suitable to reduce and/or control leakage of the working fluid around the radial flow fuel nozzle 46.

Figure 5:
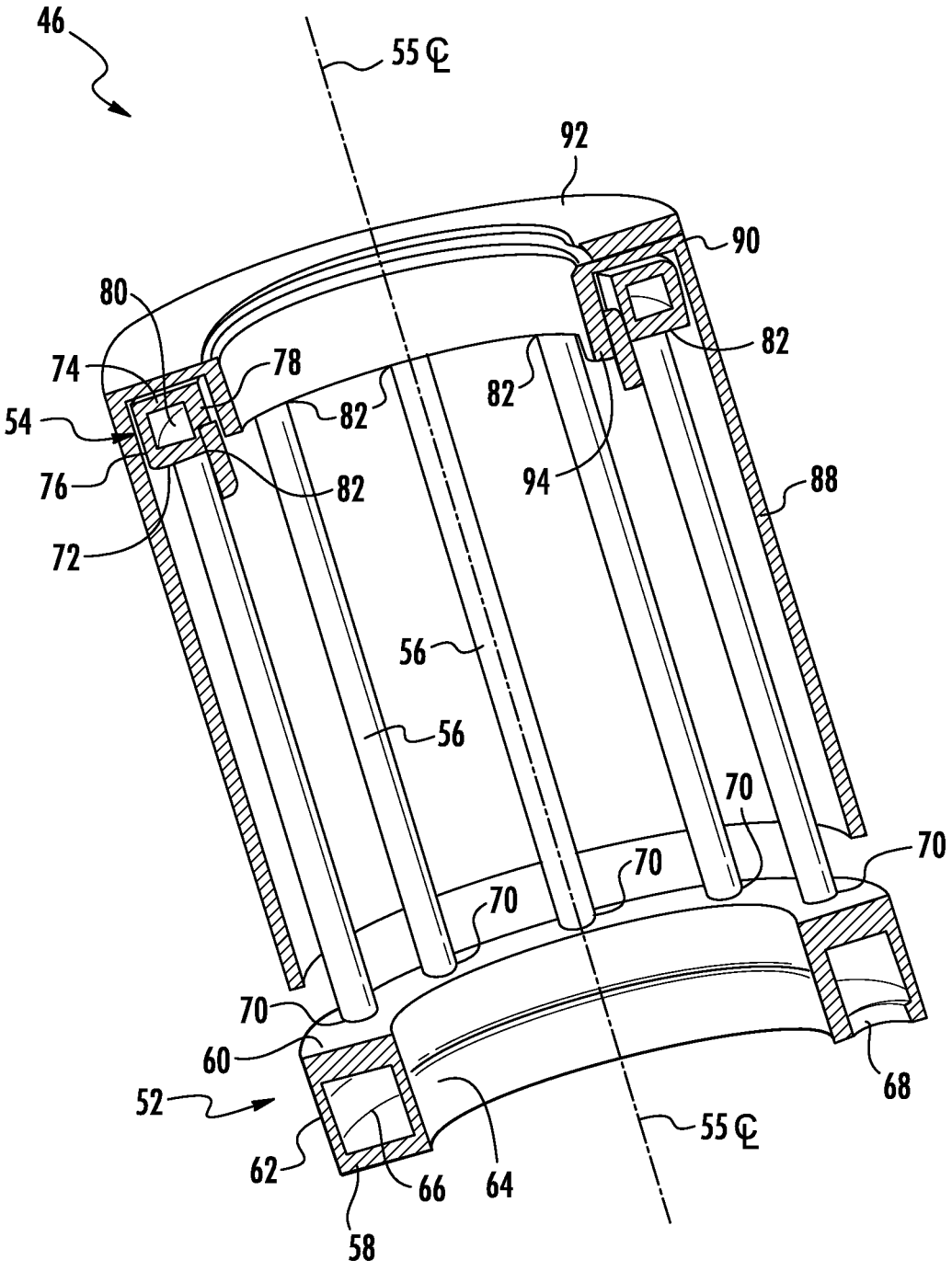
FIG. 5 is a cross-section side view of a radial flow fuel nozzle within the scope of various embodiments of the present disclosure.
Figure 6:
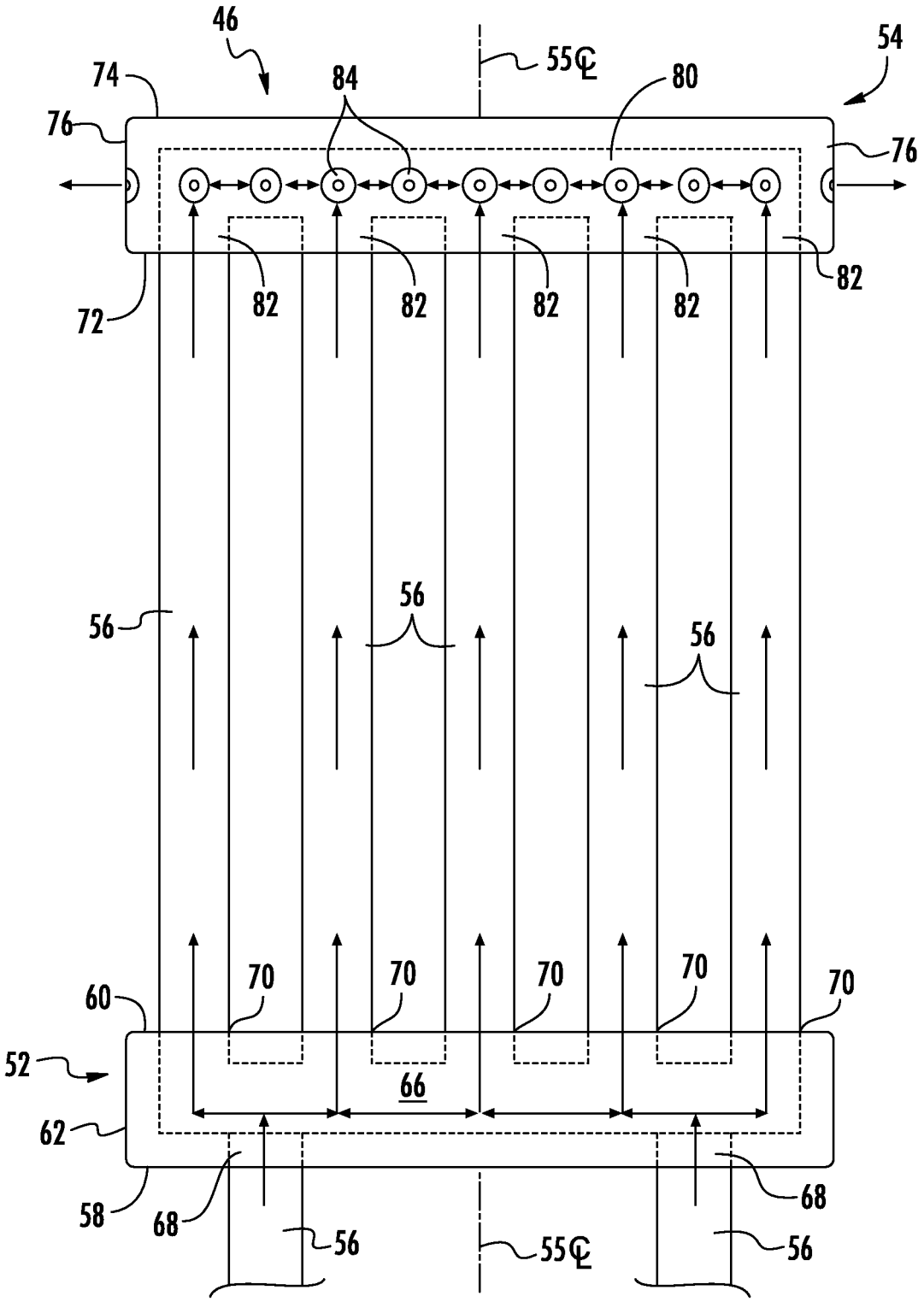
FIG. 6 is a side view of a portion of the radial flow fuel nozzle as shown in FIG. 5, within the scope of various embodiments of the present disclosure.

FIG. 5 illustrates a cross-section plan view of the radial flow fuel nozzle 46, and FIG. 6 provides front view of a portion of the radial fuel nozzle 46, as shown in FIGS. 3 and 4, according to various embodiments of the present disclosure. As shown, in FIG. 5, the radial flow fuel nozzle 46 generally includes a fuel distribution manifold 52, a fuel injection manifold 54 axially separated from the fuel distribution manifold 52 along an axial centerline 55 of the radial flow fuel nozzle 46, and a plurality of tubes 56 that extend between the fuel distribution and the fuel injection manifolds 52, 54. Although generally illustrated as cylindrical tubes 56, the tubes 56 may be any geometric shape, and the present invention is not limited to any particular cross-section unless specifically recited in the claims.

As shown in FIG. 5, the fuel distribution and fuel injection manifolds 52, 54 may be annular. However, it should be appreciated by one skilled in the art that either or both of the fuel distribution and the fuel injection manifolds 52, 54 may be any shape suitable for receiving and distributing a liquid fuel. For example, either or both of the fuel distribution and fuel injection manifolds 52, 54 may be disk shaped, torus shaped, triangular or rectangular shaped.

In particular embodiments, as shown in FIG. 5, the fuel distribution manifold 52 includes a bottom portion 58, a top portion 60, an outer side portion 62, an inner side portion 64, and a fuel plenum 66 defined within the fuel distribution manifold 52. As shown in FIGS. 5 and 6, an inlet extends through the fuel distribution manifold 52. In particular embodiments, the inlet is defined by the fuel distribution manifold 52. The inlet 68 may extend through any surface of the fuel distribution manifold 52. In particular embodiments, as shown, the inlet 68 extends through the bottom portion 58 of the fuel distribution manifold 52. As shown in FIG. 6, the inlet 68 is in fluid communication with the flexible conduit 48 shown in FIG. 4, thereby defining a fluid flow path between the end cover 14 (FIG. 14) and/or the liquid fuel supply and the fuel plenum 66. In particular embodiments, the fuel distribution manifold 52 includes a plurality of inlets 68.

As shown in FIGS. 5 and 6, a plurality of outlets 70 extends through the fuel distribution manifold 52. In particular embodiments, the plurality of outlets 70 may be defined by the fuel distribution manifold. In particular embodiments, the plurality of outlets 70 extend through the top portion of the fuel distribution manifold 52. As shown in FIG. 6, each or some of the outlets 70 define a fluid flow path between the fuel plenum 66 and the plurality of tubes 56.

In particular embodiments, as shown in FIG. 5, the fuel injection manifold 54 includes a bottom portion 72, a top portion 74, an outer side portion 76, an inner side portion 78, and a fuel plenum 80 defined within the fuel injection manifold 54. As shown in FIGS. 5 and 6, a plurality of inlets 82 extends through the fuel injection manifold 54. In particular embodiments, the plurality of inlets may be defined by the fuel injection manifold 54. The inlets 82 may extend through any surface of the fuel injection manifold 54. In particular embodiments, as shown, the inlets 82 extend through the bottom portion 72 of the fuel injection manifold 54. As shown in FIG. 6, the inlets 82 define a fluid flow path between the tubes 56 and the fuel plenum 80 of the fuel injection manifold 54.

Figure 7:
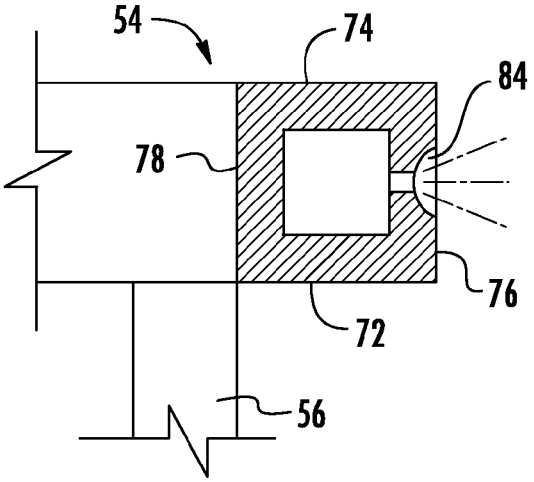
FIG. 7 is a cross-section front view of a portion of the radial flow fuel nozzle as shown in FIG. 5, within the scope of various embodiments of the present disclosure.
Figure 8:
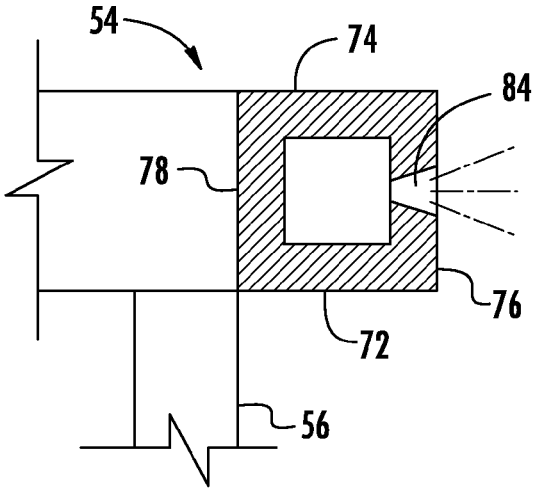
FIG. 8 is a cross-section front view of a portion of the radial flow fuel nozzle as shown in FIG. 5, within the scope of various embodiments of the present disclosure.
Figure 9:
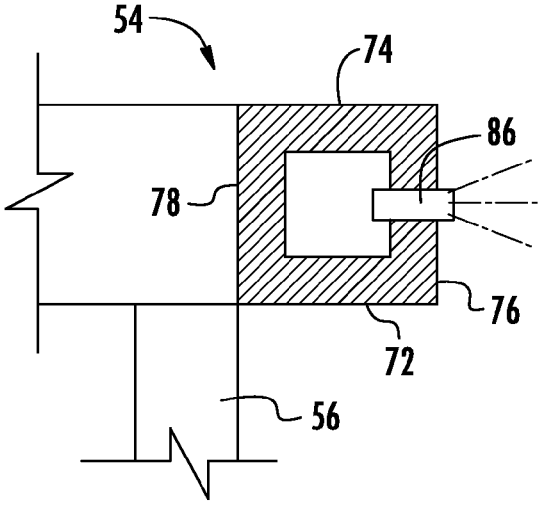
FIG. 9 is a cross-section front view of a portion of the radial flow fuel nozzle as shown in FIG. 5, within the scope of various embodiments of the present disclosure.

As shown in FIG. 6, a plurality of fuel ports 84 extends generally radially through the outer side portion 76 of the fuel injection manifold 54. In particular embodiments, the plurality of fuel ports are at least partially defined by the fuel injection manifold. The plurality of fuel ports 84 may be circumferentially spaced around the outer side portion 76. Each of the fuel ports 84 defines a flow path from the fuel plenum 80 through the outer side portion 76 of the fuel injection manifold 54. The fuel ports 84 are shaped so as to atomize liquid fuel flowing from the fuel plenum 80 through the fuel ports 84. For example, as shown in FIGS. 7 and 8, the fuel ports may have a decreasing flow area (or convex shape) and/or an increasing flow area (or concave shape). In particular embodiments, as shown in FIG. 9, each or some of the fuel ports 84 include an atomizer 86, nozzle or other flow restriction/expansion device configured to transition the liquid fuel to a mist or spray as it passes through the fuel ports 84.

In particular embodiments, as shown in FIG. 5, the radial flow fuel nozzle 46 includes an outer shroud 88. In addition, the radial flow fuel nozzle 46 may further include at least one of an impingement plate 90, a cap plate 92 or an inner shroud 94. As shown, the outer shroud 88 circumferentially surrounds the fuel injection manifold 54. In various embodiments, the outer shroud 88 is coaxially aligned with the fuel injection manifold 54 with respect to the axial centerline 55 of the radial flow fuel nozzle 46. The outer shroud 88 at least partially surrounds the plurality of tubes 56.

Figure 10:
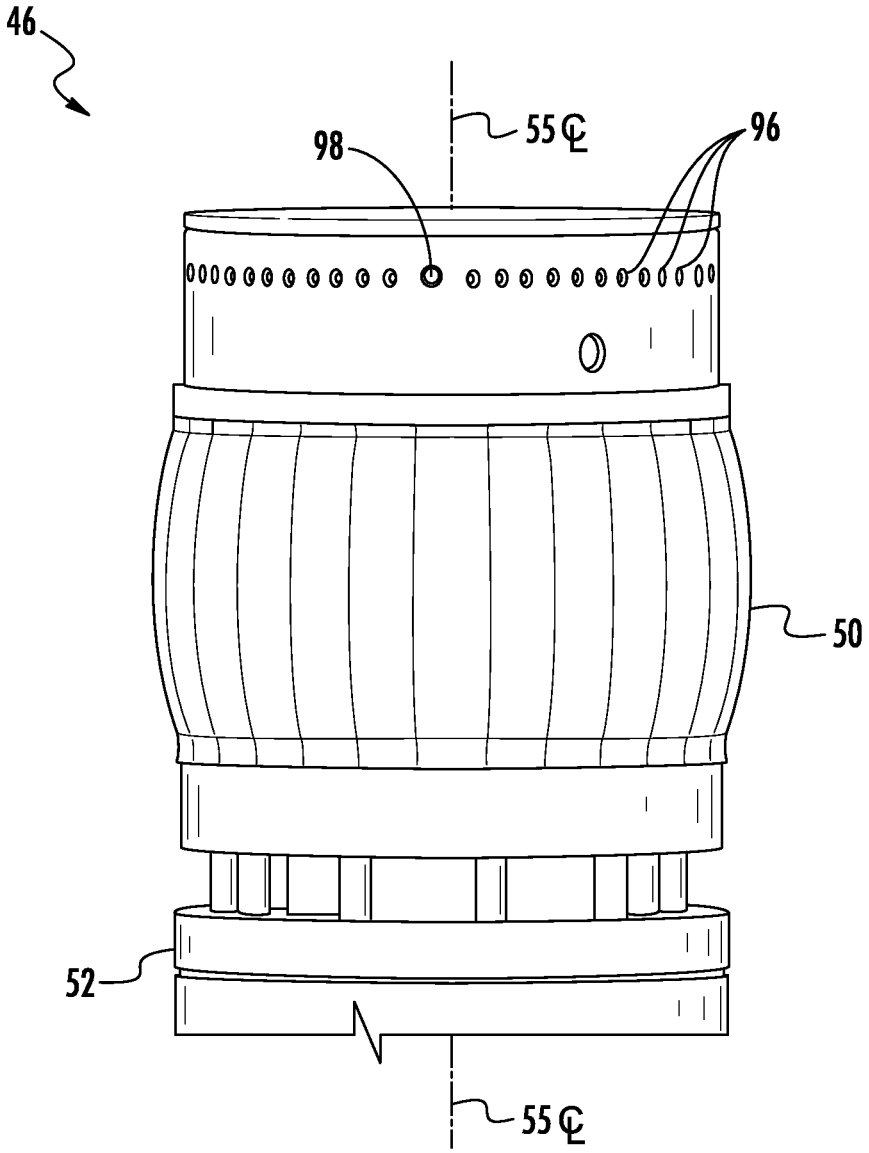
FIG. 10 is a front view of radial flow fuel nozzle as shown in FIG. 3 within the scope of various embodiments of the present disclosure.
Figure 11:
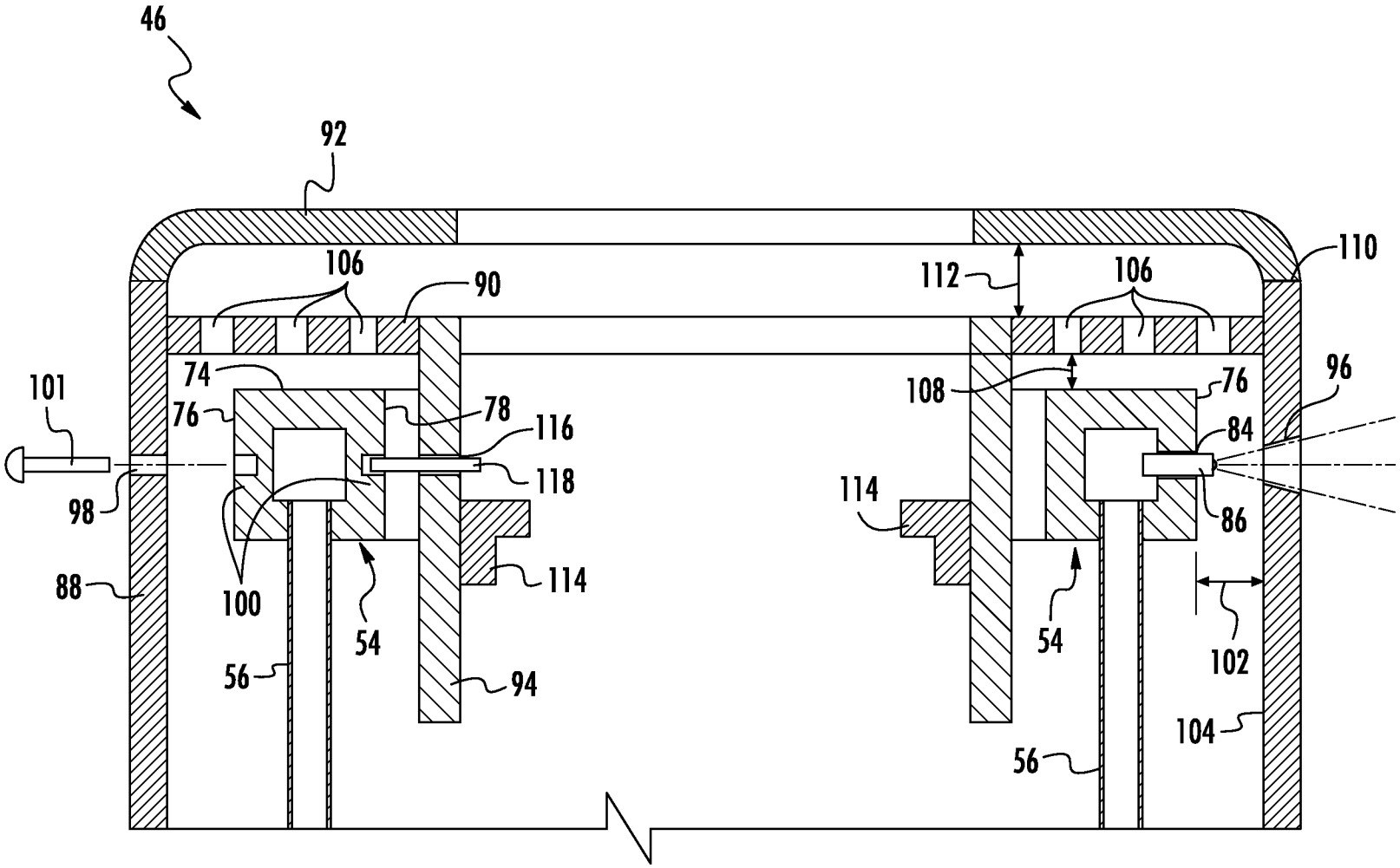
FIG. 11 is a cross-section front view of a portion of the radial flow fuel nozzle as shown in FIG. 5, within the scope of various embodiments of the present disclosure.

FIG. 10 provides a front view of the radial flow fuel nozzle 46, and FIG. 11 provides a cross-section view of a portion of the radial flow fuel nozzle as shown in FIG. 10, according to various embodiments. As shown in FIG. 10, a plurality of passages 96 extends radially through the outer shroud 88. In particular embodiments, the passages 96 are defined by the outer shroud 88. The passages 96 are circumferentially spaced around the outer shroud 88. In particular embodiments, as shown in FIG. 11, the passages 96 are generally aligned with the fuel ports 84 and/or the atomizers 86 of the fuel injection manifold 54.

As shown in FIGS. 10 and 11, the outer shroud 88 at least partially defines an alignment feature 98 such as a slot or hole that extends radially through the outer shroud 88. As shown in FIG. 11, the fuel injection manifold 54 defines an alignment feature 100 such as a slot or a hole. The alignment feature 100 of the fuel injection manifold may be positioned on at least one of the outer side portion 76 or the inner side portion 78 of the fuel injection manifold 54. In particular embodiments, the alignment feature 98 of the outer shroud 88 and the alignment feature 100 of the fuel injection manifold 54 are generally aligned, and an alignment pin 101 extends therebetween, thereby fixing the fuel injection manifold 54, the tubes 56 and the fuel distribution manifold 52 at one end to the outer shroud 88. In this manner, the fuel injection manifold 54, the tubes 56 and the fuel distribution manifold 52 may expand linearly together along the axial centerline 55 of the radial flow fuel nozzle 46 during operation of the combustor 10. In addition or in the alternative, the pins 101 allow the fuel injection manifold 54 to expand radially with respect to the axial centerline 55 within the outer shroud 88 during operation.

In particular embodiments, as shown in FIG. 11, a radial gap 102 is defined between the outer side portion 76 of the fuel injection manifold 54 and an inner wall 104 of the outer shroud 88, thereby defining a flow path for the working fluid to flow through the passages 96 of the outer shroud 88. In this manner, the working fluid may mix with the atomized fuel before flowing through the passages 96 and across the downstream plate 32 of the tube bundles 38 shown in FIG. 3.

Figure 12:
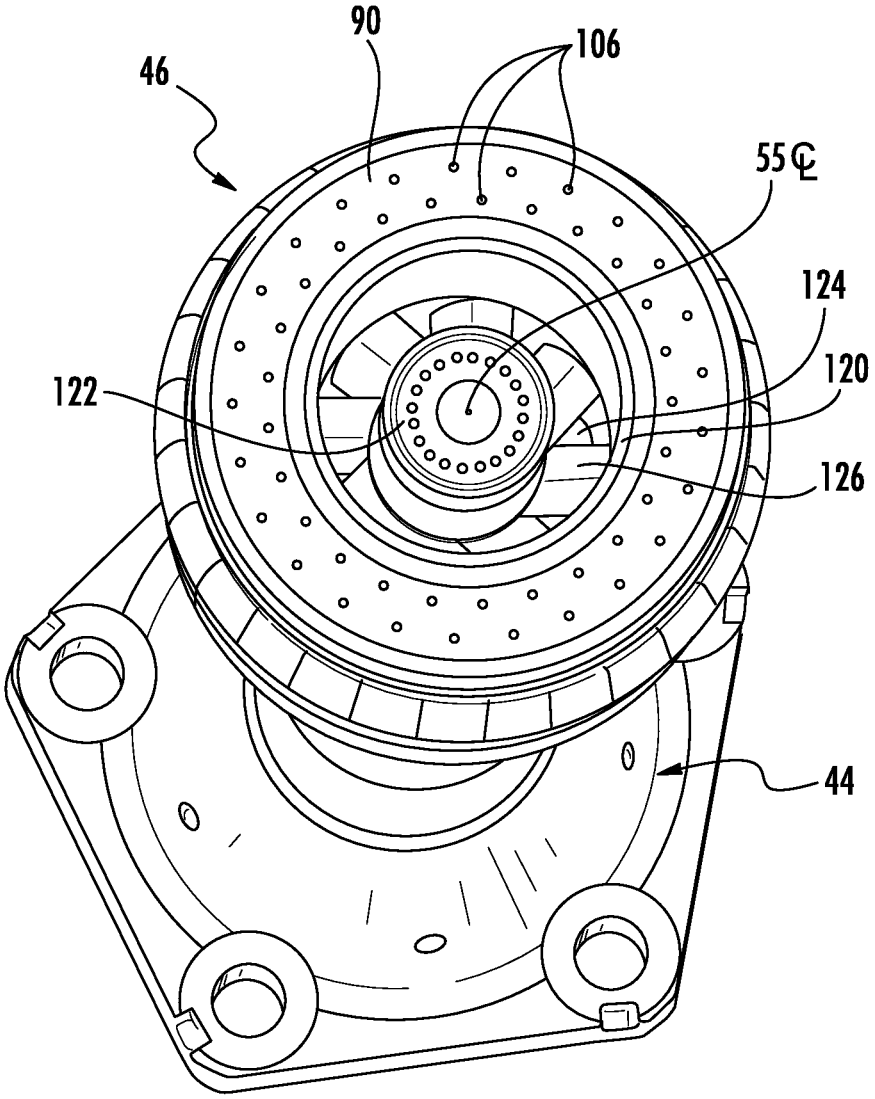
FIG. 12 is a top perspective view of the radial flow fuel nozzle and a center fuel nozzle as shown in FIG. 4, within the scope of various embodiments of the present disclosure.

FIG. 12 provides an upstream plan view of the radial flow fuel nozzle 46 including the impingement plate 90 as shown in FIG. 11 with the cap plate 92 (FIG. 11) removed for clarity. In particular embodiments, as shown in FIG. 12, the impingement plate 90 is generally annular and axially aligned with the outer shroud 88 along the axial centerline 55 of the radial flow fuel nozzle 46. A plurality of axially extending cooling passages 106 extends through the impingement plate 90. In particular embodiments, the plurality of cooling passages are defined by the impingement plate 90. As shown in FIG. 11, the impingement plate 90 may be circumferentially surrounded by the outer shroud 88. The impingement plate may be connected to the outer shroud 88 in any manner know to one of ordinary skill in the art. For example, the impingement plate 90 may be welded or brazed to the outer shroud 88. In particular embodiments, the impingement plate 90 is positioned generally adjacent to the top portion 74 of the fuel injection manifold 54. In at least one embodiment, an axial gap 108 is defined between the impingement plate 90 and the top portion of the fuel injection manifold 54.

In particular embodiments, as shown in FIG. 5, the cap plate 92 is generally annular. In alternate embodiments, the cap plate 92 may be disk shaped. As shown in FIG. 11, the cap plate 92 may be disposed at a downstream end 110 of the outer shroud 88 and/or generally adjacent to the top portion 74 of the fuel injection manifold 54. The cap plate 92 may be connected to the outer shroud 88 in any manner know to one of ordinary skill in the art. For example, the cap plate 92 may be welded or brazed to the outer shroud 88. An axial gap 112 may be defined between the impingement plate 90 and the cap plate 92. In this manner, working fluid may flow from the end cover 14, through the outer shroud 88, around the fuel injection manifold 54 and through the cooling passages 106 of the impingement plate 90, thereby providing at least one of impingement cooling, conductive or convective cooling to the cap plate 92.

As shown in FIG. 5, the inner shroud 94 is generally annular in shape. The inner shroud 94 may be coaxially aligned with the impingement plate 90 and/or the cap plate 92 with respect to the axial centerline 55 of the radial flow fuel nozzle 46. The inner shroud 94 is at least partially surrounded by the fuel injection manifold 54. The inner shroud 94 may be connected to the impingement plate 90. In particular embodiments, as shown in FIG. 11, the inner shroud 94 may include a coupling feature 114 for mounting the radial flow fuel nozzle 46 to the center fuel nozzle 44. For example, the inner shroud 94 and the burner tube 120 of the center fuel nozzle 44 may include complementary threads (not shown) to secure the inner shroud 94 to the center fuel nozzle 44.

As shown in FIG. 11, the inner shroud 94 may define an alignment slot 116 that extends generally radially through the inner shroud 94. In particular embodiments, an alignment pin 118 may extend between the alignment slot 116 of the inner shroud 94 and the alignment slot 100 of the fuel injection manifold 54, thereby joining the inner shroud 94 to the fuel injection manifold 54. In this manner, the fuel injection manifold 54, the tubes 56 and the fuel distribution manifold 52 may expand linearly together along the axial centerline 55 of the radial flow fuel nozzle 46 during operation of the combustor 10. In addition or in the alternative, the pins 118 allow the fuel injection manifold 54 to expand radially with respect to the axial centerline 55 within the outer shroud 88 during operation.

Figure 13:
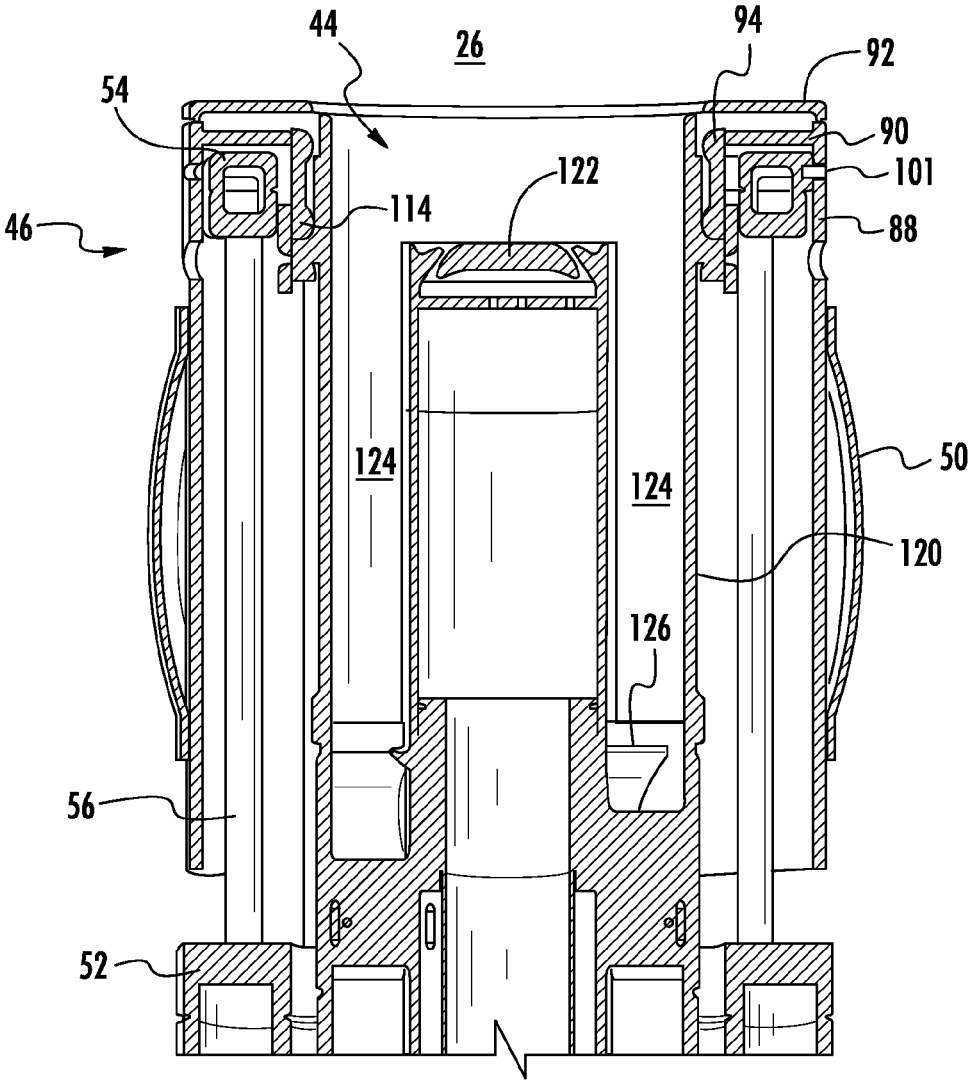
FIG. 13 is a cross-section front view of a portion of the radial flow fuel nozzle and the center fuel nozzle as shown in FIG. 12, within the scope of various embodiments of the present disclosure.

FIG. 13 provides a cross-section of the radial flow fuel nozzle 46 surrounding the center fuel nozzle 44 as shown in FIGS. 3 and 4. As shown in FIGS. 12 and 13, the center fuel nozzle 44 may include a burner tube 120 that circumferentially surrounds a center body 122 to define an annular passage 124 between the burner tube 120 and the center body 122. One or more swirler vanes 126 may be located between the burner tube 120 and the center body 122 to impart swirl to the working fluid flowing through the annular passage 124. In this manner, the center fuel nozzle 44 may provide fluid communication through the radial flow fuel nozzle 46 to the combustion chamber 26 separate and apart from the tubes 24 or the radial flow fuel nozzle 46.

In operation, in at least one embodiment, the liquid fuel flows from the liquid fuel supply (not shown), through the end cover 14, through the flexible conduit 48 and into the fuel distribution manifold 52 of the radial flow fuel nozzle 46. The liquid fuel then flows through the plurality of tubes 56 into the fuel injection manifold 54. The fuel flows through the plurality of fuel ports 84 and is atomized into a fine mist or spray. The atomized liquid fuel is directed generally radially outward across the tube bundles 38 downstream from the downstream plate 32.

Simultaneously, a first portion of the working fluid flows from the end cover 14 through the tubes 24 of the tube bundles 38 through the spray or mist of the atomized fuel and into the combustion chamber 26. In this manner, the atomized fuel and the working fluid is premixed prior to combustion within the combustion chamber 26. A second portion of the working fluid flows from the end cover into the outer shroud 88 of the radial flow fuel nozzle 46. Some of the second portion of the working fluid flows through the radial gap 102 between the outer side portion 76 of the fuel injection manifold 54 and the inner wall 104 of the outer shroud 88 and is mixed with the atomized liquid fuel as it flows through the passages 96 extending through the outer shroud 88. Some of the second portion of the working fluid flows across the fuel injection manifold and through the cooling passages 106 of the impingement plate 90. The working fluid passes through the cooling passages 106 and is directed against the cap plate 92. As a result, the working fluid provides at least one of impingement cooling, convective cooling or conductive cooling to the cap plate 92.

As the temperature within the combustor 10 increases or decreases, the plurality of tubes 56 extending between the fuel injection manifold 54 and the fuel distribution manifold 52 expand or contract linearly and/or radially with respect to the axial centerline 55 of the radial flow fuel nozzle 46. As a result, mechanical stresses within the radial flow fuel nozzle 46 due to thermal expansion are reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. A radial flow fuel nozzle for a combustor of a gas turbine, comprising:

a. a fuel distribution manifold shaped as a ring and having a bottom side wall axially spaced from a top side wall, wherein the bottom side wall defines at least one inlet that provides for fuel flow into the fuel distribution manifold and the to side wall defines a plurality of outlets circumferentially spaced about the top side wall;

b. a fuel injection manifold shaped as a ring and axially separated from and coaxially aligned with the fuel distribution manifold, the fuel injection manifold having an inner side portion radially spaced from an outer side portion, a bottom side portion axially spaced from a top side portion and perpendicular to the outer side portion and a plurality of circumferentially spaced fuel ports that extend through the outer side portion, wherein the bottom side portion defines a plurality of inlets circumferentially spaced about the bottom side portion; and c. a plurality of circumferentially spaced tubes that extend axially from the top side wall of the fuel distribution manifold to the bottom side portion of the injection manifold, wherein the plurality of circumferentially spaced tubes is annularly arranged about an axial centerline of the radial flow fuel nozzle, each tube of the plurality of circumferentially spaced tubes defining a respective fluid communication path between a respective outlet of the plurality of outlets of the fuel distribution manifold and a respective inlet of the plurality of inlets of the fuel injection manifold.

2. The radial flow fuel nozzle as in claim 1, further comprising a plurality of atomizers, wherein each atomizer is disposed within a respective fuel port of the plurality of circumferentially spaced fuel ports of the fuel injection manifold.

3. The radial flow fuel nozzle as in claim 1, further comprising an inner shroud at least partially surrounded by the inner side portion of the fuel injection manifold.

4. The radial flow fuel nozzle as in claim 1, further comprising an outer shroud that circumferentially surrounds the fuel injection manifold, the outer shroud having a downstream end, the outer shroud defining a plurality of circumferentially spaced passages that extend radially through the outer shroud, each passage being aligned with a respective fuel port of the plurality of circumferentially spaced fuel ports of the fuel injection manifold.

5. The radial flow fuel nozzle as in claim 4, wherein a radial gap is defined between an inner surface of the outer shroud and the outer side portion of the fuel injection manifold.

6. The radial flow fuel nozzle as in claim 4, further comprising an impingement plate adjacent to the downstream end of the outer shroud.

7. The radial flow fuel nozzle as in claim 4, further comprising a cap plate adjacent to the downstream end of the outer shroud.

8. The radial flow fuel nozzle as in claim 4, further comprising an alignment pin that extends between the fuel injection manifold and the outer shroud.

9. A combustor for a gas turbine, comprising:

a. an end cover having an outer side axially separated from an inner side;

b. a center fuel nozzle that extends axially away from the inner side of the end cover; and c. a radial flow fuel nozzle that at least partially surrounds the center fuel nozzle, the radial flow fuel nozzle comprising:

i. a fuel distribution manifold shaped as a ring and having a bottom side wall axially spaced from a topside wall, wherein the bottom side wall defines at least one inlet that provides for fuel flow into the fuel distribution manifold and the top side wall defines a plurality of outlet circumferentially spaced about the top side wall;

ii. a fuel injection manifold coaxially aligned with and axially spaced downstream from the fuel distribution manifold, the fuel injection manifold being shaped as a ring having a plurality of circumferentially spaced fuel ports that extend radially through an outer side portion of the fuel injection manifold, wherein a bottom side portion of the fuel injection manifold is perpendicular to the outer side portion and defines a plurality of inlets circumferentially spaced about the bottom side portion; and iii. a plurality of circumferentially spaced tubes that extend between the fuel distribution manifold and the fuel injection manifold, wherein the plurality of circumferentially spaced tubes is annularly arranged about an axial centerline of the radial flow fuel nozzle, each tubes of the plurality of circumferentially spaced tubes defining a respective fluid communication path between a respective outlet of the plurality of outlets of the fuel distribution manifold and a respective inlet of the plurality of inlets of the fuel injection manifold.

10. The combustor as in claim 9, wherein the radial flow fuel nozzle further comprises a plurality of atomizers, each atomizer being disposed within a respective one fuel port of the plurality of circumferentially spaced fuel ports of the fuel injection manifold.

11. The combustor as in claim 9, further comprising a flexible conduit in fluid communication with the fuel distribution manifold, wherein the flexible conduit is in fluid communication with a liquid fuel supply.

12. The combustor as in claim 9, wherein the radial flow fuel nozzle further comprises an outer shroud that circumferentially surrounds the fuel injection manifold, the outer shroud having a downstream end, the outer shroud defining a plurality of circumferentially spaced passages that extend radially through the outer shroud, each passage being aligned with a respective fuel ports of the plurality of circumferentially spaced fuel ports of the fuel injection manifold.

13. The combustor as in claim 12, wherein the radial flow fuel nozzle further comprises an annular impingement plate adjacent to the downstream end of the outer shroud.

14. The combustor as in claim 12, wherein the radial flow fuel nozzle further comprises an annular cap plate adjacent to the downstream end of the outer shroud.

15. The combustor as in claim 12, wherein the radial flow fuel nozzle further comprises an inner shroud at least partially surrounded by the inner side portion of the fuel injection manifold.

16. The combustor as in claim 15, wherein the radial flow fuel nozzle further comprises an alignment pin that extends between the fuel injection manifold and at least one of the inner shroud or the outer shroud.

17. A combustor for a gas turbine, comprising:

a, an annular array of tube bundles that extends radially across at least a portion of the combustor, each tube bundle having a respective downstream plate and a respective plurality of tubes that extend through the downstream plate;

b. a fuel nozzle passage that extends axially through the annular array of tube bundles; and c. a radial flow fuel nozzle that extends axially through the fuel nozzle passage, the radial flow fuel nozzle comprising:

i. a fuel distribution manifold;

ii. a fuel injection manifold downstream from the fuel distribution manifold, the fuel injection manifold having an inner side portion, an outer side portion, and a plurality of circumferentially spaced fuel ports that extend through the outer side portion;

iii. a plurality of tubes that extends between the fuel distribution manifold and the fuel injection manifold, each tube defining a fluid communication path between the fuel distribution manifold and the fuel injection manifold; and iv. an outer shroud that circumferentially surrounds the fuel injection manifold, the outer shroud defining a plurality of circumferentially spaced passages that extend radially through the outer shroud, at least some of the circumferentially spaced passages being aligned with at least some of the circumferentially spaced fuel ports.

18. The combustor as in claim 17, wherein the plurality of circumferentially spaced passages and the plurality of circumferentially spaced fuel ports of the radial flow fuel nozzle are positioned downstream from the respective downstream plate of each respective tube bundle of the annular array of tube bundles.

19. The combustor as in claim 17, further comprising a flexible conduit in fluid communication with fuel distribution manifold, wherein the flexible conduit is in fluid communication with a liquid fuel supply.

20. The combustor as in claim 17, wherein the fuel injection manifold further defines an alignment feature and the outer shroud further defines an alignment slot, and the radial flow fuel nozzle further includes an alignment pin that extends between the fuel injection manifold and the outer shroud.

* * * * *